United States Patent [19]

Brown

[11] Patent Number: 4,457,728

[45] Date of Patent: Jul. 3, 1984

[54] STORAGE TRANSFER AND PRODUCTION MARINE PLATFORM

[76] Inventor: Robert L. Brown, 27594 Parkview Blvd., Warren, Mich. 48092

[21] Appl. No.: 378,740

[22] Filed: May 17, 1982

[51] Int. Cl.[3] ..... B63B 27/34

[52] U.S. Cl. ..... 441/4; 141/387

[58] Field of Search ..... 114/230, 264; 441/3, 441/4, 5; 405/210; 137/236 R, 236 S; 166/344, 347; 141/387, 388, 229

[56] References Cited

U.S. PATENT DOCUMENTS

| | | | |
|---|---|---|---|
| 3,111,692 | 12/1963 | Cox | 137/236 |
| 3,187,355 | 6/1965 | Wassenaar et al. | 441/5 |
| 3,541,622 | 11/1970 | Harlow | 441/5 |
| 3,612,177 | 11/1971 | Wilson et al. | 166/344 |
| 3,735,435 | 5/1973 | Mikulicic et al. | 441/5 |

*Primary Examiner*—Trygve M. Blix
*Assistant Examiner*—Thomas J. Brahan
*Attorney, Agent, or Firm*—Harpman & Harpman

[57] ABSTRACT

A floating transfer and production platform for use in a marine environment includes a plurality of petroleum storage and mooring tanks movably positioned around a central transfer and well platform. A central stationary oil drilling shaft enclosed within a rotatable outer assembly for oil production is combined with multiple manifolds for the transferring of petroleum products between tankers, the storage tanks, and the shore. The well platform provides for a production well, the products of which can be transferred to tanker, storage tanks, or shore.

5 Claims, 6 Drawing Figures

STORAGE TRANSFER AND PRODUCTION MARINE PLATFORM

BACKGROUND OF THE INVENTION (1) Field of the Invention

This invention relates to marine platforms for the production, storage, and transfer of petroleum products.

(2) Description of the Prior Art

Prior art devices of this type have utilized a variety of different approaches to the problem, see for example U.S. Pat. Nos. 3,472,032, 4,042,990, 3,572,278 and 4,007,599.

In U.S. Pat. No. 4,042,990, a single point mooring terminal is disclosed which has a combined spar-type buoy and a submerged buoy to compensate for wave movement and tidal changes.

U.S. Pat. No. 3,572,278 describes a floating production platform having a vertical annular buoyancy chamber made from a plurality of cylindrical shelves on which the platform is supported and to which tankers can be moored.

Applicant's earlier U.S. Pat. No. 4,007,599 discloses a marine platform having multiple floating docks positioned around a fixed central platform. The docks can rotate and move vertically around the central core area.

In U.S. Pat. No. 3,472,032 a production and storage system is disclosed wherein a flexible conduit is utilized between the platform and the well head on the ocean floor.

Applicant's present invention discloses a storage transfer and production platform with a plurality of storage, and docking tanks movably positioned around a platform having a number of multiple manifolds positioned around a central production shaft. The main portion of the platform is moored in position by self-adjusting multiple cables and anchor assemblies with the central production shaft being rotatable within.

SUMMARY OF THE INVENTION

A storage transfer and production platform takes the form of a cylindrical structure around a stationary production shaft that is secured to the sea bottom by a plurality of adjustable cable and anchor assemblies. The platform has a plurality of arcuately shaped storage and mooring tanks individually secured by flexible means to the platform. Multiple manifolds regulate and transfer the flow of the product from and to the tanks, moored ships, a production well and the shore.

DESCRIPTION OF THE PREFERRED EMBODIMENT

Figure 1:
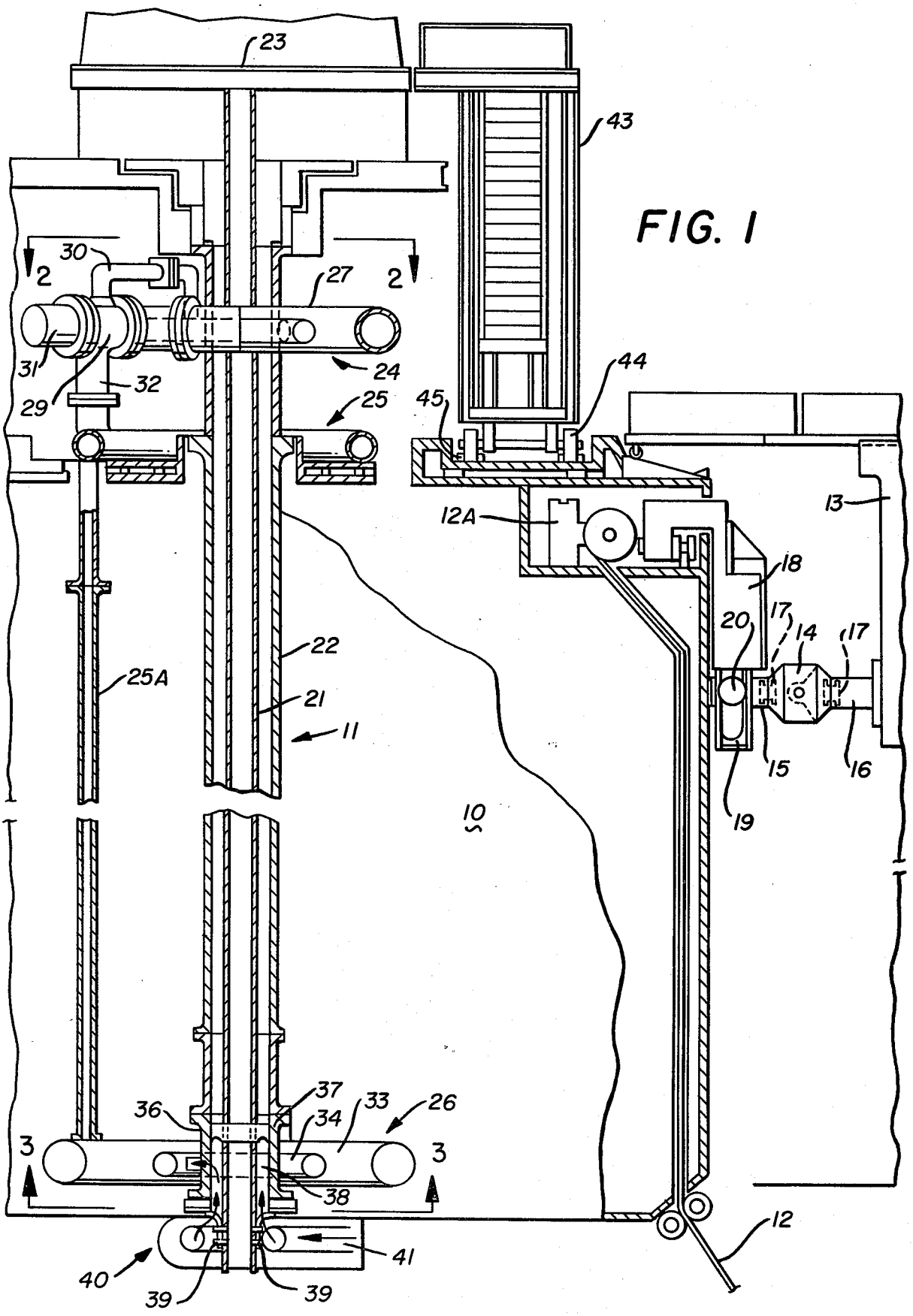
FIG. 1 is a side elevation with parts in cross section and parts broken away illustrating the marine platform of the present invention.

A storage transfer and production marine platform as best seen in FIG. 1 of the drawings, comprises a closed cylindrical structure 10 having a central passageway 11.

The floating cylindrical structure 10 is secured to the sea bed by a plurality of anchor cables 12 controlled by a motor and reel assembly 12A. The anchor cables 12 maintain the platform position in relation to the sea bed. A plurality of arcuately shaped tanks 13 are each flexibly secured to the platform by a device 14 having horizontally disposed shafts 15 and 16 extending between said platform and said tanks, respectively.

Each of the shafts 15 and 16 have a bearing assembly 17 that allows for the independent motion in relation to the device 14. The device 14 is comprised of a pair of pivoted members that allow for up and down pitch of the respective shafts 15 and 16 in response to wave motion and changes in water level.

The cylindrical structure 10 has an annular ring 18 that is rotatably positioned thereon to which the shafts 15 are movably secured by vertical guide supports. The vertical guide supports are formed of elongated slotted members 19 which are engaged by annular flanged members 20. The shafts 15 are secured to the flanged members 20 so that vertical movement of the shafts 15 and respective flanged members 20 can take place. The annular ring 18 and the vertical guide supports in combination with the shafts 15 and 16 and pivot device 14 allows for diverse movement of the attached floating tanks 13 in relation to the cylindrical structure 10.

A stationary well production shaft 21 is positioned within an outer shaft assembly 22 which forms the passageway 11 and can connect a well head, not shown, to a drilling rig, not shown, which would be positioned on a stationary drilling platform 23 on the upper part of the floating cylindrical structure 10. Three circular manifold assemblies, 24, 25, and 26 are positioned in spaced vertical relation to one another around the outer shaft assembly 22.

Figure 2:
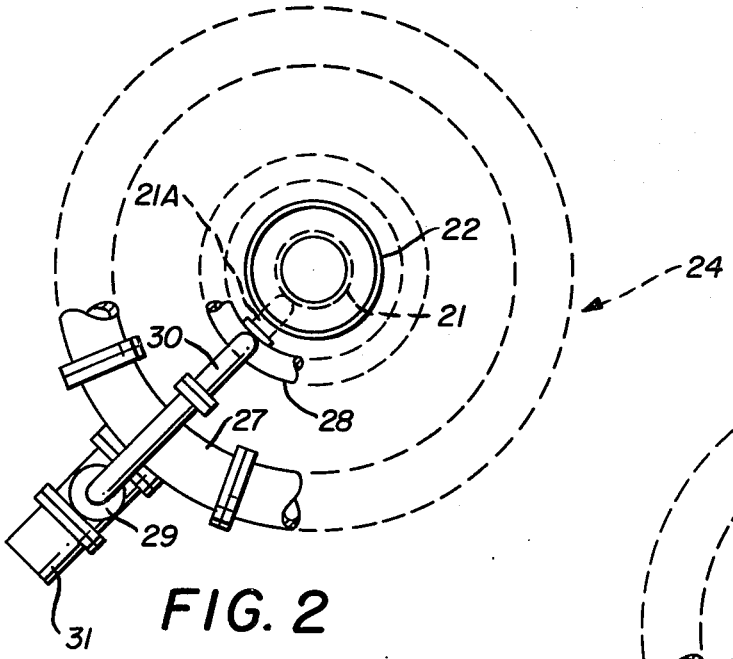
FIG. 2 is a secion on line 2—2 of FIG. 1.

Referring now to FIGS. 1 and 2 of the drawings, the uppermost manifold assembly 24 will be seen to comprise an outer circular tube 27 and an inner circular tube 28. The outer tube 27 communicates with a plurality of four-way valve assemblies 29 circumferentially spaced therearound, each valve 29 having a tubular member 30 communicating with said inner circular tube 28, a port for a flexible line 31 for connection with a ship, and a pipe 32 communicating with the manifold 25. The outer circular tube 27 is used for ship to ship transfers through the four-way valves 29 and the flexible lines 31. The inner circular tube 28 is in communication with the production shaft 21 and receives the product therefrom through a secondary tubular member 21A. The four-way valves 29 direct flow either to or from the manifold 25, the inner circular tube 28, and the outer circular tube 27.

Figure 3:
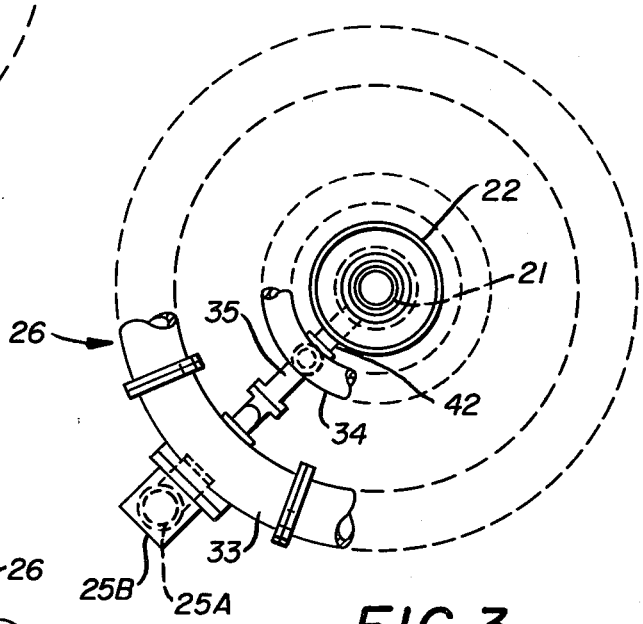
FIG. 3 is a section on line 3—3 of FIG. 1.
Figure 4:
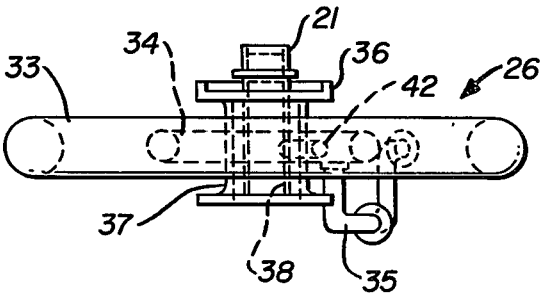
FIG. 4 is a side elevation of a portion of the marine platform.

Referring now to FIGS. 1, 3 and 4 of the drawings, the manifold 26 can be seen having an outer secondary tube 33 and an inner secondary tube 34. A transfer pipe 35 connects the outer and inner secondary tubes 33 and 34 respectively. A plurality of delivery tubes 25A extend from the manifold 25 to fittings 25B communicating with the outer secondary tube 33. An oil transfer device 36 is positioned adjacent the lowermost end of the outer shaft assembly 22 and has an annular housing 37 defining a chamber 38. The transfer device 36 has bearing and seal assemblies 39 which allow it to rotate 360 around the stationary well production shaft 21.

Figure 5:
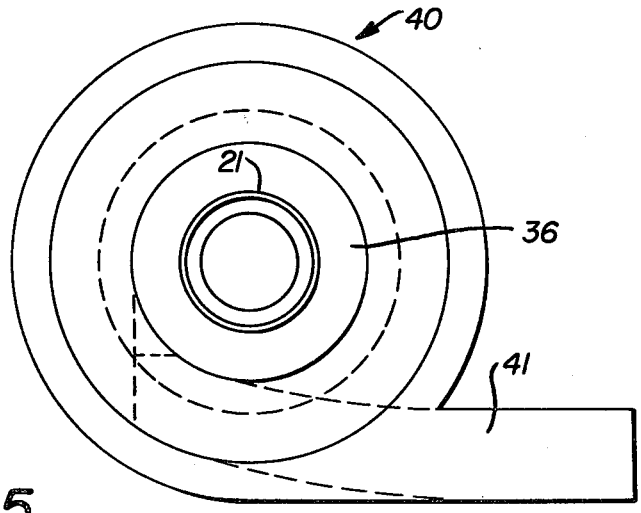
FIG. 5 is a top plan view of a portion of the marine platform.
Figure 6:
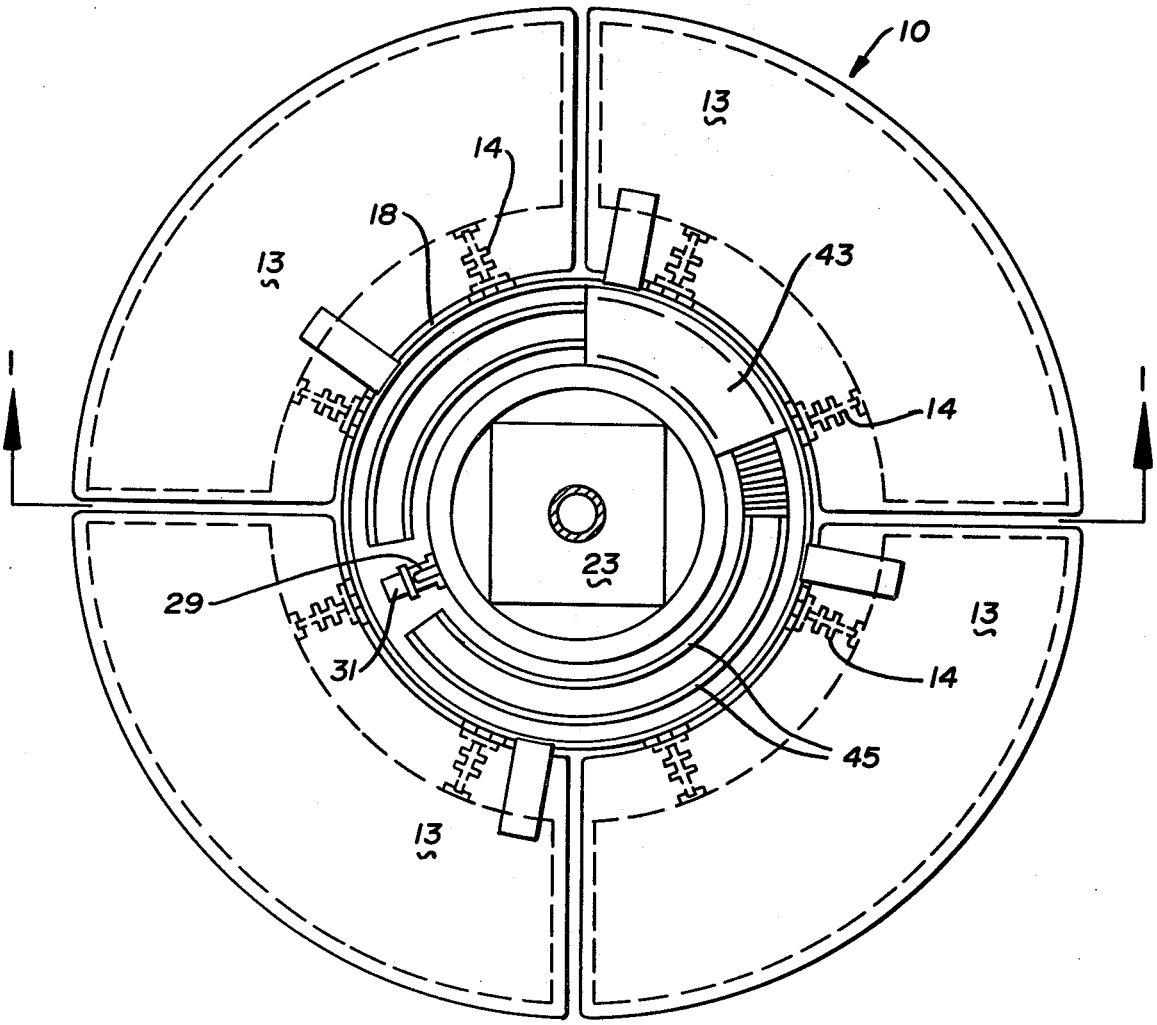
FIG. 6 is a top plan view of the marine platform.

Referring to FIGS. 1 and 5 of the drawings, a shore supply and transfer manifold 40 is positioned adjacent the lower end of the product transfer device 36 with a shore line 41 communicating therewith. In one mode of operation, the product enters the transfer manifold 40 from the shore line 41 and flows into the transfer device 36 as indicated by arrows in FIG. 1 of the drawings. The product is then transferred from the transfer device 36 into the inner ring 34 by a fitting indicated by the numeral 42. The product passes through the transfer pipe 35 into the outer ring 33 and up the delivery tubes 25A into the manifold 25 for distribution to the four-way valve via the pipes 32. A plurality of movable working platforms 43 are supported on wheels 44 that follow form tracks 45 in the upper surface of the cylindrical structure 10 and can be rotated as the tanks 13 rotate remaining in stationary relation to the well production shaft 21. The multiple manifolds and valve assemblies can transfer petroleum products from a number of ships docked to the rotatable tanks 13 through the flexible lines 31 as will be apparent to those skilled in the art.

Products can also be transferred from ship to ship and from ship to shore or directly from the well production stationary shaft 21 to either the tanks 13 or ships or directly to shore.

The above described storage transfer and production platform provides an efficient and cost effective way of carrying out multiple operations from a variety of different sources. The transfer of petroleum products or the like in an interconnected self-contained platform environment.

The design of the platform makes its possible to accommodate a number of different ships successfully even during periods of unsuitable weather conditions and the accompanying unstable waters, by rotation of the tanks 13 to which the ships are moored.

Although but one embodiment of the present invention has been illustrated and described, it will be apparent to those skilled in the art that various changes and modifications may be made herein without departing from the spirit of the invention and having thus described my invention what I claim is:

1. In a floating marine terminal the combination of a closed cylindrical structure having an annular revolvable ring thereon, a plurality of buoyant tanks arranged around said cylindrical structure, movable means connecting said tanks and said revolvable ring and means forming a central vertical passageway through said closed cylindrical structure, a platform on said closed cylindrical structure, a well production shaft extending through said passageway and communicating with said platform, a plurality of vertically spaced circular manifolds about said passageway, at least two of said circular manifolds consisting of radially spaced inner and outer members, a plurality of four-way valves on said outer member of the uppermost one of said circular manifolds and communicating therewith, with said inner member thereof and with one of said circular manifolds therebelow, circumferentially spaced tubes connecting said last mentioned circular manifold with the outer circular member of the other one of said two circular manifolds having radially spaced inner and outer members and means connecting said last mentioned outer circular member to the inner circular member of said other one of said two circular members having radially spaced inner and outer members, a chamber formed around said passageway adjacent the lower portion of said closed cylindrical structure and means communicating with said last mentioned inner circular member and said chamber, said chamber arranged to be placed in communication with lines extending from said floating marine terminal to shore, flexible lines on said closed cylindrical structure in communication with said four-way valves and arranged for communication with ships secured to said bouyant tanks of said floating marine terminal.

2. The floating marine terminal set forth in claim 1 in which said closed cylindrical structure, the passageway therethrough and the plurality of vertically spaced circular manifolds about said passageway are revolvable relative to said well production shaft extending therethrough.

3. The floating marine terminal set forth in claim 1 and wherein a transfer manifold is positioned below said closed cylindrical structure in communication with said chamber formed around said vertical passageway to facilitate connection of said shore lines to said marine terminal.

4. The improvement in a floating marine terminal set forth in claim 1 and wherein said plurality of buoyant tanks are arcuately shaped and positioned in a circular pattern around said closed cylindrical structure.

5. The improvement in a floating marine terminal set forth in claim 1 and wherein means is provided on said closed cylindrical structure for rotating said annular revolvable ring thereon.

* * * * *